US006155409A

United States Patent [19]

Hettinger

[11] Patent Number: 6,155,409

[45] Date of Patent: Dec. 5, 2000

[54] PERSONAL EMERGENCY INFORMATION AND MEDICATION HOLDER

[76] Inventor: Gary F. Hettinger, 3407 Christopher Trail, Jeffersonville, Ind. 47130

[21] Appl. No.: 09/443,333

[22] Filed: Nov. 19, 1999

[51] Int. Cl.[7] ..... B65D 83/04; A45C 15/00

[52] U.S. Cl. ..... 206/38; 206/534; 63/19; 63/1.14

[58] Field of Search ..... 206/37, 38, 457, 206/458, 528, 530, 534, 539, 811; 63/18, 19, 1.14; 24/3.4; 40/1.5; 224/257, 258; 53/409, 467, 468

[56] References Cited

U.S. PATENT DOCUMENTS

| | | | |
|---|---|---|---|
| 17,137 | 4/1857 | Bloomer . | |
| D. 164,522 | 5/1951 | Stageberg . | |
| D. 338,850 | 8/1993 | Nachshen . | |
| 367,087 | 7/1887 | Briggs . | |
| D. 382,223 | 8/1997 | Harrison . | |
| 718,562 | 7/1903 | Blackinton . | |
| 767,836 | 8/1904 | Rice . | |
| 919,983 | 4/1909 | Walsh . | |
| 1,061,364 | 5/1913 | Ewing | 63/19 |
| 1,122,941 | 12/1914 | Kameras et al. | 63/19 |
| 3,407,523 | 10/1968 | Winston | 63/18 |
| 4,197,665 | 4/1980 | Siiter | 63/18 |
| 5,390,510 | 2/1995 | Tirio-Cloonan | 63/18 |
| 5,414,948 | 5/1995 | Kudo | 63/19 |

*Primary Examiner*—Jacob K. Ackun
*Assistant Examiner*—Luan K. Bui
*Attorney, Agent, or Firm*—Richard C. Litman

[57] ABSTRACT

A personal emergency information and medication holder which appears like a locket or pocket watch and can be worn on the person. The holder contains an emergency quantity of medication to be taken if necessary. The holder also contains a Universal Product Code, or other scannable code, which can be scanned by medical or emergency personnel in the event of a crisis. A computer database that has retrievable medical information which can be identified by the Universal Product Code contained in the wearer's holder is necessary.

9 Claims, 4 Drawing Sheets

PERSONAL EMERGENCY INFORMATION AND MEDICATION HOLDER

BACKGROUND OF THE INVENTION

1. Field of the Invention

The present invention relates to a wearable personal emergency information and medication holder, and a method for using the personal emergency information and medication holder. The holder has the appearance of a pocket watch or a locket which contains therein a space for medication and a place for a scannable code such as a universal product code (UPC). The scannable code can be utilized by doctors and emergency staff to determine the medical history plus other personal medical and emergency information about the wearer.

2. Description of the Related Art

Small pill containers designed to be carried or worn on the person are known in the prior art. U.S. Pat. No. 4,420,076 issued to Beveridge et al. on Dec. 13, 1983 discloses a moisture resistant, quick release pill container for wearing which is shaped like a pill bottle with a loop on the lid for receiving a chain from which the pill bottle is suspended. U.S. Pat. No. 4,733,807 issued to Porter et al. on Mar. 29, 1988 shows a medicinal container constructed of a holder adapted to receive and hold a bottle containing medicinal tablets, and being suspendable from a chain. U.S. Pat. No. 4,866,952 issued to Hight et al. on Sep. 19, 1989 shows a container for medications formed of two interfitting halves which are held together in gas-tight relation by a resiliently flexible seal, the resiliently flexible seal permitting ready separation of the container halves by an incapacitated person, and the container can be suspended from a chain and worn.

Other wearable holders are also known. U.S. Design Pat. No. 164,522 issued to Stageberg on September 1951 shows a coin holder or the like which has a circular shape having two parts and an interior space; the outer sides of which are tapered toward the bottom and a hole for receiving a chain or such is located in the top to facilitate wearing the holder like a necklace. U.S. Design Pat. No. 338,850 shows a pendent which is generally round in shape with two halves that fit together and open up about a hinge on one side like a pocket watch. U.S. Pat. No. 17,137 issued to Bloomer on Apr. 28, 1857 discloses an improved method of making lockets and discloses lockets which are formed from two halves substantially alike, connected by a hinge and held shut by a spring catch having a ringlet from which to suspend the locket. U.S. Pat. No. 367,087 issued to Briggs on Jul. 26, 1887 shows an improved locket being made from a single piece of stock and having a beaded or ornamented edge. U.S. Pat. No. 718,562 issued to Blackinton on Jan. 13, 1903 shows another improved locket having an integral, hidden hinge and having an internal flange. U.S. Pat. No. 767,836 issued to Rice on Aug. 16, 1904 shows a locket which does not require solder and has two halves connected by a hinge and a ring for receiving a chain. U.S. Pat. No. 2,239,009 issued to Mark on Apr. 22, 1941 discloses a locket designed to be suspended from a chain about the wearer's neck having an aspect for receiving a keepsake such as a photograph.

Likewise, emergency information, medical information, and identification pendants and bracelets are known in the prior art. U.S. Design Pat. No. 382,223 issued to Harrison on Aug. 12, 1997 shows a medical locket that appears to have two halves, a hinge, a ring for receiving a chain and an accordion information paper therein. U.S. Pat. No. 919,983 issued on Apr. 27, 1909 shows an identification device which can be utilized as a key chain, a pocket item or on baggage which is round with a folded accordion identification strip sheet which is held in place by a sliding cover. U.S. Pat. No. 1,255,870 issued to Foster on Feb. 12, 1918 shows an identification tag locket or holder which has two hingedly connected sections that are secured closed by the spring catch, each section is designed to receive either a picture or an identification form, and having a place for a ribbon to fit through a recess. U.S. Pat. No. 4,249,330 issued on Feb. 10, 1981 to Chioffe shows a pendant type capsule to be worn like jewelry and having a small microfilm containing the medical history or medical and personal information, together with a lens and means of holding the film in order to focus on the film and read it. U.S. Pat. No. 4,984,683 issued to Eller on Jan. 15, 1991 discloses a decorative piece of personal jewelry, such as, a locket worn around the neck on a chain or a bracelet worn on the wrist having a compartment within the jewelry containing an attached identification and medical history of the wearer on a folded piece of waterproof paper.

None of these patents disclose an aesthetically pleasing locket containing emergency medication and medical information. Also, none of the previous references have the capacity to include a large volume of medical and personnel emergency information; these inventions only have space for a limited amount of emergency information.

None of the above inventions and patents, taken either singularly or in combination, is seen to describe the instant invention as claimed. Thus, a personal emergency medication holder solving the aforementioned problems is desired.

SUMMARY OF THE INVENTION

The present invention relates to a wearable personal emergency information and medication holder. The holder has the appearance of a pocket watch or locket which contains therein a space for medication and a place for a scannable code similar to a universal product code. The scannable code can be utilized by doctors and emergency staff to determine the medical history, plus other personal information, about the wearer.

The current invention is unique and distinguishable from the prior art in that it has the potential to make a far greater amount of medical information available than is found on traditional medical bracelets or necklaces. Also, the present invention is unique in that it additionally provides for a water-resistant medication holding area which will serve to both keep the medication dry and close by the wearer in case of an emergency.

Accordingly, it is a principal object of the invention to provide a personal emergency and medication holder which has a sealed container for receiving and storing medication on the person. The current invention has a receptacle for receiving and holding medication. The receptacle contains an emergency amount of medication. For example, an individual with a history of heart troubles might need to carry an aspirin tablet in case a heart attack occurs. In order to minimize the damage caused by a heart attack, individuals who can take aspirin should take aspirin immediately following the initial signs of a heart attack.

It is another object of the invention to provide a method to deliver complete and accurate medical history and pertinent information to medical personnel even if the patient is incapable of providing or unwilling to provide the necessary information.

It is a further object of the invention to provide a convenient means for identifying an individual who may be unable to identify themselves either because of a temporary or permanent medical condition.

Still, another object of the invention is to provide the above-mentioned benefits in a decorative and appealingly designed piece of jewelry. The piece of jewelry could contain an identification mark so as to alert the emergency medical personnel to the medical information contained therein.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

The present invention is a personal emergency information and medication holder which appears like a locket or a pocket watch and can be worn on the person. The holder contains an emergency quantity of medication to be taken if necessary. The holder also contains a Universal Product Code, or other scannable code, which can be scanned by medical or emergency personnel in the event of a crisis. A computer database that has retrievable medical information which can be identified by the Universal Product Code contained in the wearer's holder is a necessary aspect of the current invention. The computer database, however, is conventional and will not be described in depth.

Figure 1:
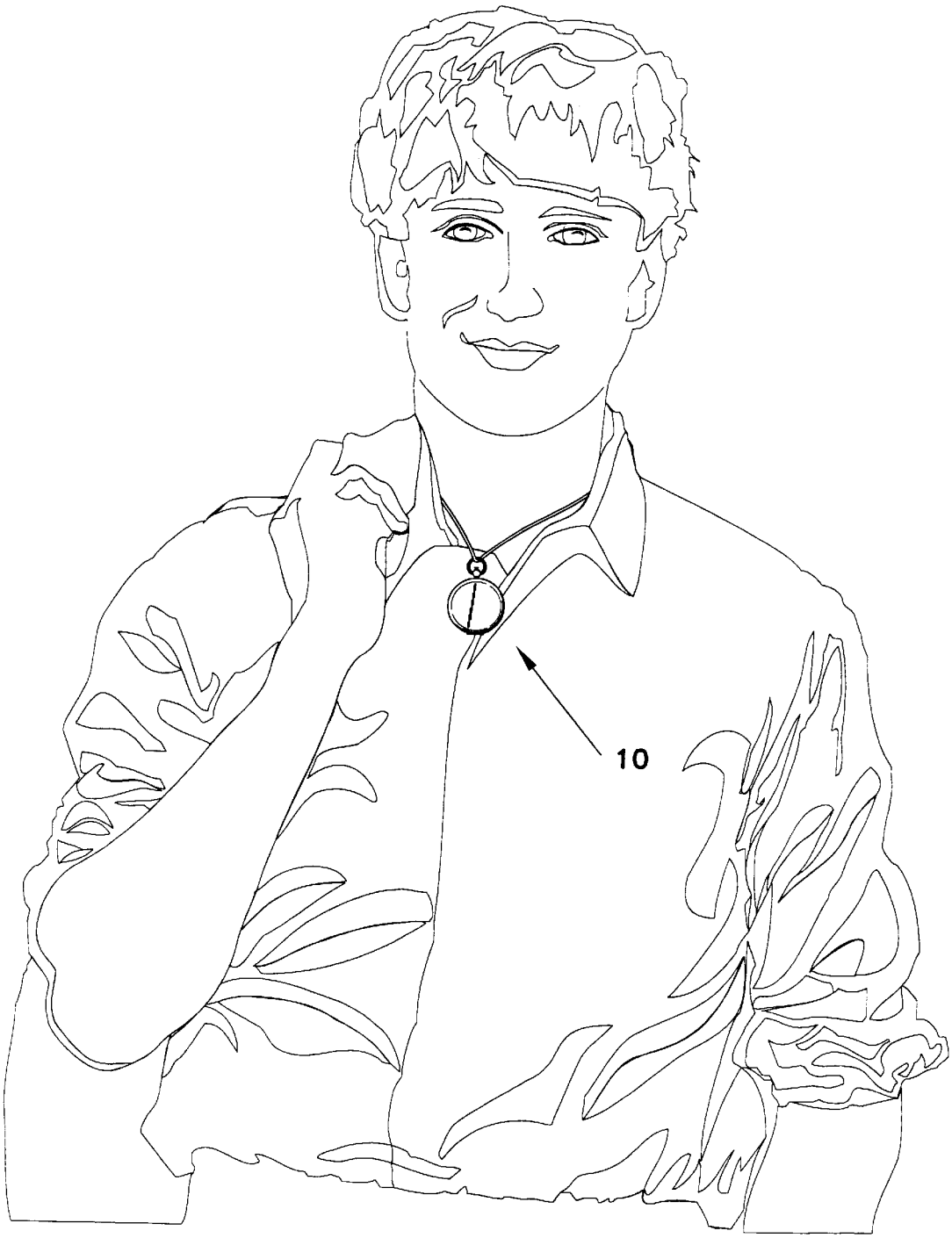
FIG. 1 is an environmental view of a personal emergency medication holder according to the present invention.

FIG. 1 depicts an embodiment of the personal emergency information and medication holder 10 as envisioned by the current invention. The holder 10 is a decorative piece of jewelry which can be worn at all times. The holder 10 may be fashioned to look like a locket and worn around the neck on a string A or chain. Conversely, the holder 10 may be worn in the pocket like a pocket watch. The decorative appearance of the holder 10 may take many forms not inconsistent with the claims herein. In other words, the holder 10 may be circular, oval in shape, square, rectangular or any other shape which is compatible with the basic structure thereof.

Figure 2:
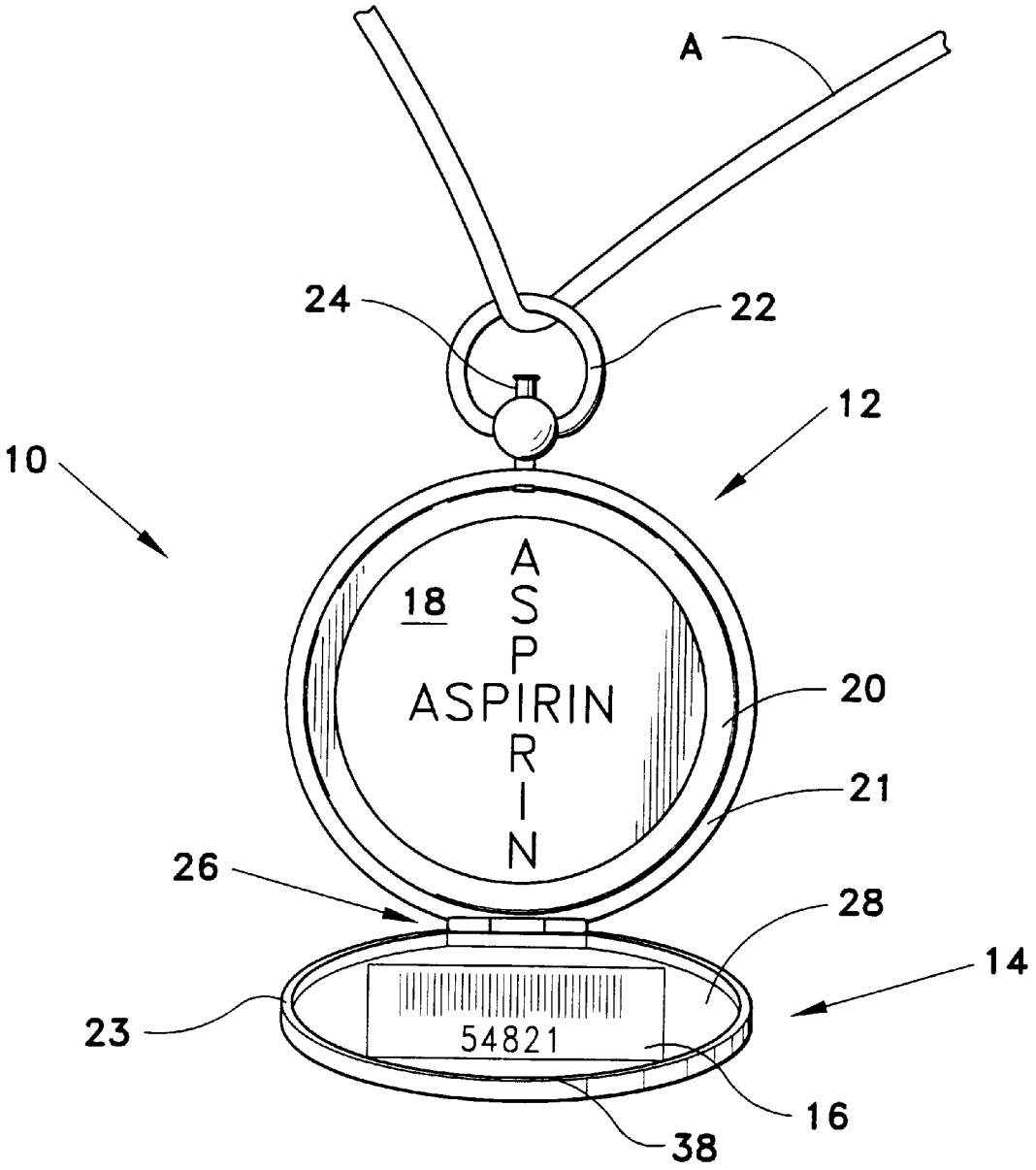
FIG. 2 is a perspective view of the present invention in an open position.

The personal emergency information and medication holder 10 has a first part 12 and a second part 14, as shown in FIG. 2. The first part 12 has a base 26*a*, a top 36 opposite the base 26*a*, an outer surface 32, and an inner surface opposite the outer surface 32. Also, there is a ring 22 disposed on the top 36 of the first part 12 with a spring catch 24 running through the ring 22.

Figure 5:
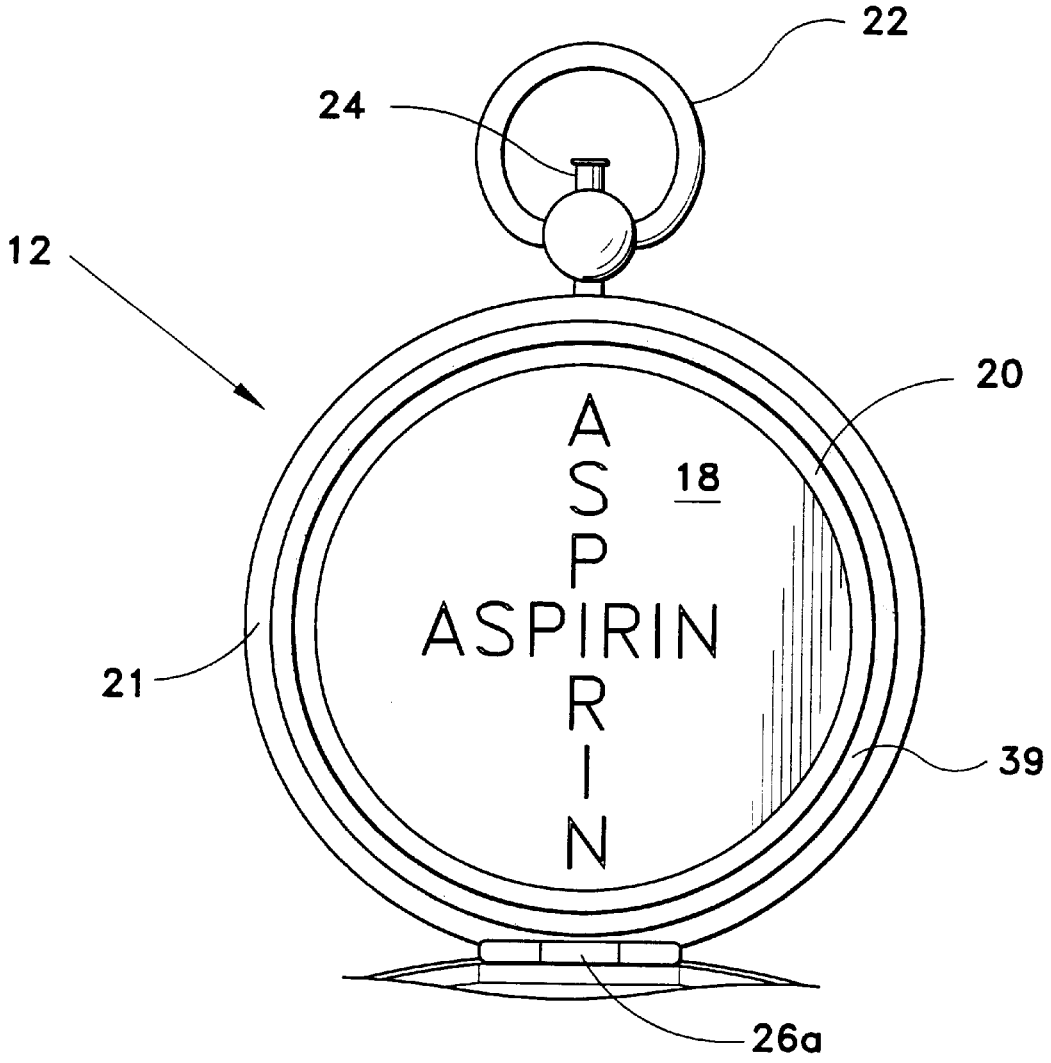
FIG. 5 is a top view of the first shell of the present invention having a medication tablet inserted therein.

The inner surface of the first part 12 has a receptacle 34 for receiving a medication containing insert 18, a ridge 20 disposed thereon encompassing the receptacle 34, and a rim 21 encompassing the periphery of the first part 12. At least one medication tablet 18 is placed in the receptacle 34. FIGS. 2 and 5 show an embodiment wherein only one aspirin tablet 18 is inserted in the holder 10 which was designed to receive only one tablet 18 of the size of an aspirin tablet. The size of the receptacle 34 varies from holder to holder depending on the total volume of medication needed in an emergency by the intended wearer thereof.

Figure 3:
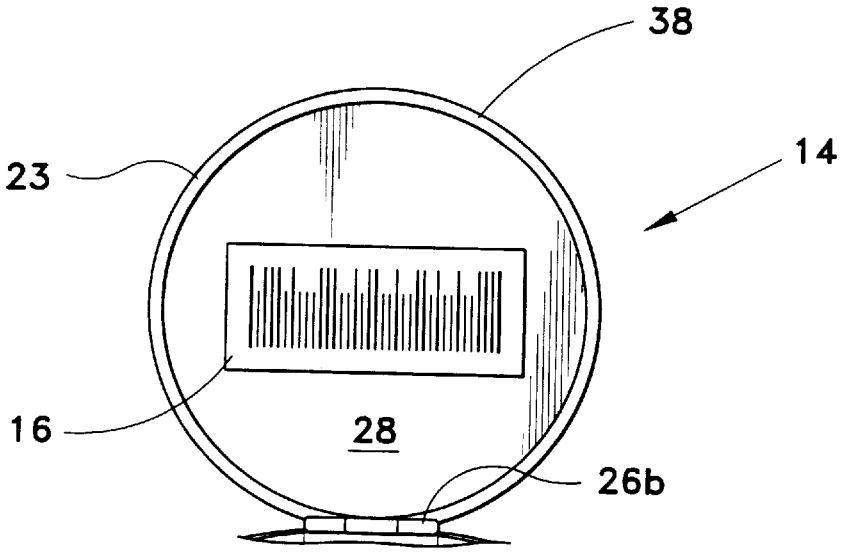
FIG. 3. is a top view of the universal product code containing emergency information as located on the second shell of the present invention.

The second part 14, shown in FIG. 3, also has a base 26*b*, a top 38 opposite the base, an outer surface 30, an inner surface 28 opposite the outer surface, and a rim 23 encompassing the periphery of the second part 14. The rim 23 of the second part 14 has a protrusion at the top 38 for receiving the spring catch 24 of the first part thus latching the first part 12 and the second part 14 closed. The holder 10 is opened by pressing down on the spring catch 24. The spring catch 24 may be attached to the ring 22 so that the holder 10 may be opened by pressing down on the ring 22.

Figure 4:
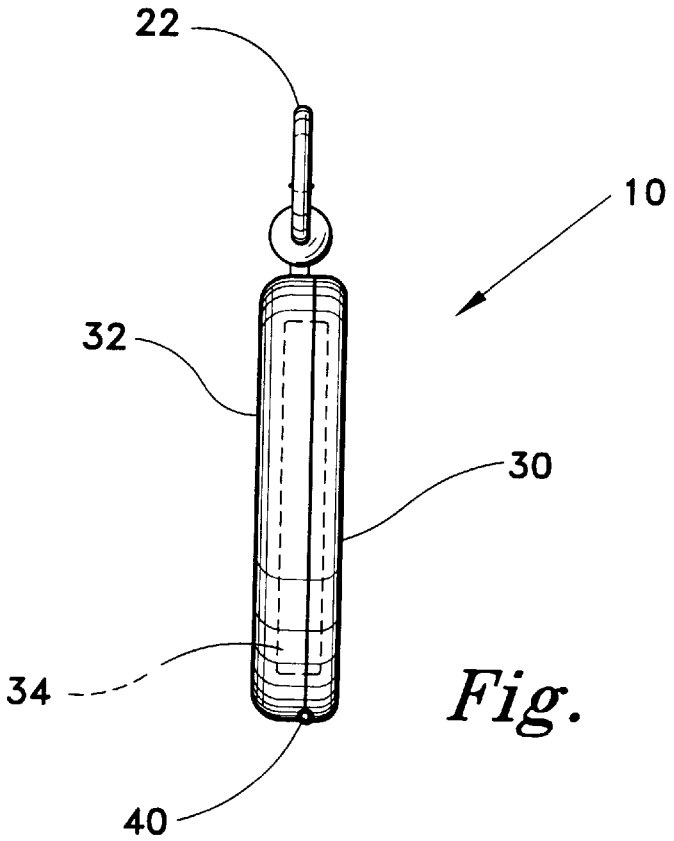
FIG. 4 is a side view of the present invention showing the outline of the inner compartment formed when the two shells are closed.

The first and second parts, 12 and 14, of the holder 10 are hingedly attached to one another. Ideally, the base 26*a* of the first part forms the first half of a hinge 26 and the base 26*b* of the second part forms the second half of the hinge 26. A metal or plastic pin 40, as shown in FIG. 4, may be used to hold the hinge 26 together. Conversely, the hinge halves may snap together to form the hinge 26. An O-ring 39, as shown in FIG. 5, may be used to encircle the ridge 20 and assure a water-resistant seal when the two parts are latched closed.

The inner surface of the second part 14 has a scannable code 16, such as a Universal Product Code, disposed thereon. The scannable code 16 can be used in a medical emergency to retrieve medical information from a computer database. When the wearer of the holder 10 purchases the holder 10, or gets the holder 10 from his health care provider, his health care provider can then upload his medical history to the database which can be easily accessed with the proper codes by any medical facility. The medical history will be downloaded to the database in the proper place to be identified by the scannable code 16. The medical history in the database may be updated from time to time as needed. When necessary, emergency and medical personnel can access the wearer's medical history by utilizing the scannable code and retrieving the information contained in the database. In circumstances where the wearer of the current invention is likely to be incapacitated in an emergency, a medical emblem may be disposed on the outer surface 30 of the second part 14 in order to alert emergency and medical personnel as to the function of the holder 10.

It is to be understood that the present invention is not limited to the embodiment described above, but encompasses any and all embodiments within the scope of the following claims.

I claim:

1. A personal emergency medication holder comprising:

an ornamental locket having a first part and a second part;

the first part having a base, a top opposite the base, an outer surface, an inner surface opposite the outer surface, a ring disposed on the top of the first part, a spring catch running through the ring, the inner surface of the first part having a receptacle for receiving a medication, a ridge disposed on the inner surface of the first part encompassing the receptacle, and a rim encompassing the periphery of the first part;

the second part having a base, a top opposite the base, an outer surface, an inner surface opposite the outer surface, and a rim encompassing the periphery of the second part;

a means for latching the first and the second parts closed;

the inner surface of the second part having a scannable code disposed thereon; and the base of the first part being hingedly attached, by a hingedly attachment means, to the base of the second part.

2. The holder according to claim 1, wherein said means for latching the first and the second part together is the rim of the second part having a protrusion at the top for receiving the spring catch and latching the first and second parts closed.

3. The holder according to claim 1, further comprising a medical emblem disposed on the outer surface of the second part.

4. The holder according to claim 1, further comprising an O-ring encircling the ridge and assures a water-resistant seal when the two parts are latched closed.

5. The holder according to claim 1, wherein the spring catch is attached to the ring thus permitting opening by pushing down on the ring.

6. A method for using emergency medication holder of claim 1, comprising the steps of:

storing medical information about the wearer of the holder in a database easily accessed by computer;

scanning of the Universal Product Code by emergency personnel or other medical personnel;

retrieving emergency medical information from computer database; and using the emergency medical information.

7. A personal emergency medication holder comprising:

an ornamental locket having a first part and a second part;

the first part having a base, a top opposite the base, an outer surface, an inner surface opposite the outer surface, a ring disposed on the top of the first part, a spring catch running through the ring, the inner surface of the first part having a receptacle for receiving a medication, a ridge disposed on the inner surface of the first part encompassing the receptacle, and a rim encompassing the periphery of the first part;

the second part having a base, a top opposite the base, an outer surface, an inner surface opposite the outer surface, and a rim encompassing the periphery of the second part;

the rim of the second part having a protrusion at the top for receiving the spring catch and latching the first and second parts closed;

the inner surface of the second part having a scannable code disposed thereon;

the base of the first part being hingedly attached, by a hingedly attachment means, to the base of the second part;

a medication containing insert; and an O-ring encircling the ridge for providing a water-resistant seal when the two parts are latched closed.

8. The holder according to claim 5, further comprising a medical emblem disposed on the outer surface of the second part.

9. The holder according to claim 5, wherein the spring catch is attached to the ring thus permitting opening by pushing down on the ring.

* * * * *